US006669658B2

(12) United States Patent
Fumanelli

(10) Patent No.: US 6,669,658 B2
(45) Date of Patent: Dec. 30, 2003

(54) APPARATUS FOR EXECUTION OF HYDROMASSAGES

(76) Inventor: Giuseppe Ezio Fumanelli, Via Prealpi, 3 - I-20066, Melzo (Province of Milan) (IT)

( * ) Notice: Subject to any disclaimer, the term of this patent is extended or adjusted under 35 U.S.C. 154(b) by 31 days.

(21) Appl. No.: 09/910,025

(22) Filed: Jul. 23, 2001

(65) Prior Publication Data

US 2002/0013543 A1 Jan. 31, 2002

(30) Foreign Application Priority Data

Jul. 21, 2000 (IT) ..... MI2A01663
Apr. 3, 2001 (IT) ..... MI2000196 U

(51) Int. Cl.[7] ..... A61H 9/00; A61H 33/62
(52) U.S. Cl. ..... 601/155; 601/158; 601/168
(58) Field of Search ..... 601/151, 152, 601/148, 154, 155, 156, 158, 160, 166–169; 4/559, 541.5, 541.1–541.4

(56) References Cited

U.S. PATENT DOCUMENTS 3,636,944 A * 1/1972 Bryant ..... 601/160
4,468,822 A * 9/1984 McKay ..... 601/168
4,986,781 A * 1/1991 Smith ..... 4/541.3
5,105,804 A * 4/1992 Van Nostrand ..... 601/157
5,408,707 A * 4/1995 Wilson ..... 4/541.5
6,027,464 A * 2/2000 Dahlquist ..... 601/160
6,183,430 B1 * 2/2001 Lin ..... 601/168

* cited by examiner

*Primary Examiner*—Danton D. DeMille
*Assistant Examiner*—Quang D Thanh
(74) *Attorney, Agent, or Firm*—Browdy and Neimark, P.L.L.C.

(57) ABSTRACT

An apparatus for execution of hydromassages is provided which comprises an operating unit (1*a*) to be plunged into water, delimiting a space (10) for at least one person and having at least one float (5) and one dispensing structure (2) supported by the float (5), the dispensing structure being provided with diffuser holes (3) for emission of a fluid under pressure for hydromassage, the apparatus further comprising feeding members (1*b*) to supply fluid under pressure, disposed externally of the operating unit (1*a*) which conveys the fluid to the operating unit (1*a*).

27 Claims, 5 Drawing Sheets

APPARATUS FOR EXECUTION OF HYDROMASSAGES

FIELD OF THE INVENTION

The invention relates to an apparatus for execution of hydromassages to be used in big masses of water adapted for bathing and also suitable for treatments of thalassotherapy (therapy for the treatment of thalassemia), iodotherapy (treatment for lack of iodine) and the like.

DESCRIPTION OF THE PRIOR ART

It is known that execution of hydromassages has been hitherto possible in common tubs of bathrooms or in bathtubs of thermal systems, in which the water, quantitatively limited, is submitted to typical turbulent motions necessary for hydromassage by use of apparatus that are placed at the bottom and/or in the side walls of the tubs themselves or integrated therewith.

Due to the necessary presence of tubs that must be expressly equipped, hydromassages have been excluded until now from places where big masses of water are present and in general from environments where a person can freely immerse himself/herself in water. In this way the advantages resulting from hydromassages get lost exactly in the places where contact with water is most sought-after.

Likewise, hydromassages are not available to persons using small- and medium-sized boats, taking into consideration the bulkiness of the necessary equipment that is not compatible with said small and medium-sized boats and this in spite of the fact that boats are naturally put in places having substantially unlimited water amounts.

SUMMARY OF THE INVENTION

Under this situation the technical task underlying the invention is to devise an apparatus capable of substantially remedy the mentioned drawbacks.

Within the scope of this technical task it is an important aim of the invention to devise an apparatus enabling execution of hydromassages in open places that have been hitherto excluded from this practice, in particular in places suitable for swimming where great amounts of water in which a person can immerse himself/herself are available.

Another important aim is to devise an apparatus for execution of hydromassages that can be easily and quickly installed and then possibly removed.

A further important aim is to devise an apparatus that is of easy transportability and limited bulkiness above all when it is not in an operating position and is housed in a boat for example.

A still further aim is to devise a greatly versatile apparatus capable of adapting itself to the most different environmental conditions and users' requirements, and also usable for treatments of different types such as thalassotherapy and iodotherapy.

The technical task mentioned and the aims specified are achieved by an apparatus for execution of hydromassages comprising at least one operating unit to be plunged into water and delimiting at least one space to house at least one person, said operating unit having at least one dispensing structure provided with diffuser holes for dispensing a fluid under pressure necessary for hydromassages and at least one float adapted to support said dispensing structure immersed in the water, the apparatus further comprising feeding means adapted to cause flowing of said fluid under pressure towards said space.

BRIEF DESCRIPTION OF THE DRAWINGS

Further features and advantages of the invention will be best clarified in the following detailed description of preferred embodiments of the invention, with reference to the accompanying drawings, in which.

DESCRIPTION OF THE PREFERRED EMBODIMENTS

Figure 1:
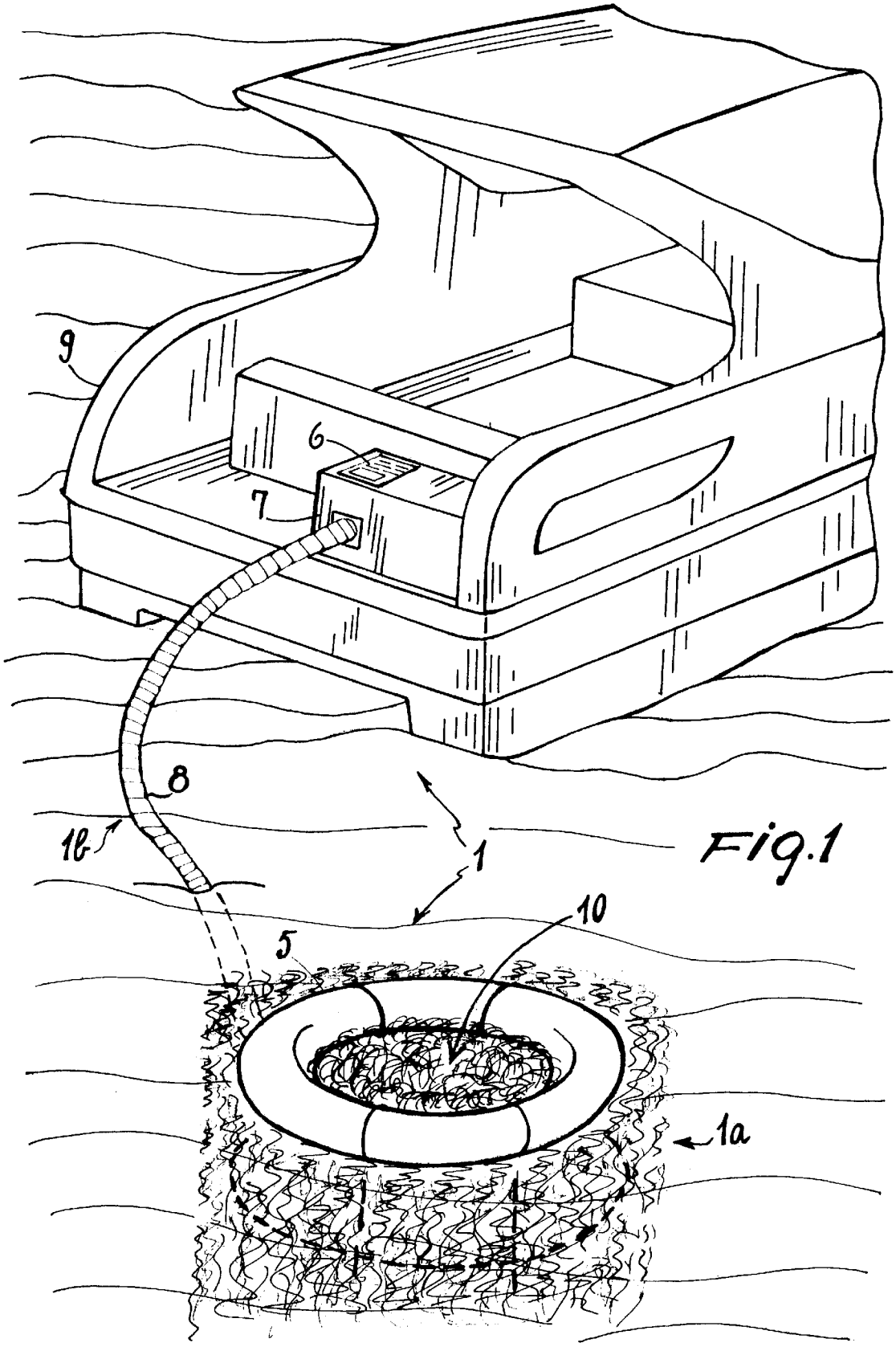
FIG. 1 is a diagrammatic view showing how an apparatus in accordance with the invention is used in the vicinity of a boat.

With reference to the drawings, the apparatus for execution of hydromassages is generally identified by reference numeral 1. It comprises an operating unit 1*a* adapted to hold at least one person and means 1*b* for feeding fluid under pressure, disposed externally of the operating unit 1*a*.

The operating unit 1*a* comprises at least one dispensing structure 2 to be plunged into water and provided with diffuser holes 3 for emission of the fluid necessary to carry out the hydromassage or treatment: the fluid generally is air under pressure that sets in motion the water with which it comes into contact and makes it turbulent so as to form a multiplicity of flows suitable for hydromassage at the inside of the mass of water.

The dispensing structure 2 pierced with holes is connected by support means 4 to at least one float 5 conveniently sized so as to generate a hydrostatic thrust sufficient to keep the perforated dispensing structure 2 itself suspended in the water even when a person takes place therein.

Float 5, which may be of the single or multiple type, may consist of a mere inflatable life belt or a rigid buoy. It forms the upper edge of the operating unit 1*a*. Engagement between float 5 and the dispensing structure 2 pierced with holes can be obtained by any type of support means 4, a mere sling for example, formed of bands in the form of loops, by virtue of which the dispensing structure 2 is hanging from float 5.

The support means 4 can be conceived for a spaced apart and partly free mounting between float 5 and the perforated dispensing structure, or a close contact can be created between these parts so as to form a single body on installation.

The feeding means 1*b* is on the contrary associated with support structures or elements different from said float and is substantially independent of the support action of float 5.

In particular, the fluid under pressure is conveyed to the operating unit 1*a* by the feeding means 1*b* comprising control members 6, compression members consisting of a compressor 7 for example, and flexible channeling members 8 consisting for example of a flexible tube or hose.

Compressor 7 can be positioned on a boat 9 or on the border of a swimming-pool or on a wharf.

The control members 6 may also comprise a remote control switch for remote actuation of compressor 7.

Advantageously float 5 has an annular conformation, in the form of a life belt, and in cooperation with the dispensing structure 2 it delimits a space or cavity or water volume 10 useful for hydromassage, substantially having the conformation of a bathtub to hold at least one person, possibly two or more persons. Float 5 practically is the upper edge of space 10.

The dispensing structure 2 comprises a bottom or platform 11 enabling a person to rest thereon and defining the lower base of space 10.

Platform 11 can be advantageously defined by a mere net, or it may itself be a dispensing element for the fluid under pressure. The distance of platform 11 from float 5 can be modified by adjusting means 12 described in the following, so that it can be adapted to the height of the person wishing to take advantage of the apparatus for hydromassage.

Since said apparatus can also be used in open waters and therefore with the possible presence of currents and wave motions, it is provided that a stabilization mass 11*a* of appropriate weight should be suspended below the dispensing structure 2, under bottom 11.

The stabilization mass 11*a* is not required if the dispensing structure 2 has a weight of its own of sufficient amount.

Then a bag or holding band 13 of the laminar type is preferably provided around the dispensing structure 2; it is preferably of colored or transparent plastic material and is capable of preventing the turbulence useful in carrying out a hydromassage from dispersing laterally of the structure, due to the presence of currents or wave motions for example.

However the band 13 itself is preferably provided with openings 13*a* to reduce the resistance of the operating unit to currents or wave motions.

The holding band 13 can be made rigid with the dispensing structure 2 so as to substantially define a bathtub therewith.

In the particular embodiment shown in FIGS. 2 to 5, the dispensing structure 2 is formed of tubular elements or tubes that are partly rectilinear and partly annular, are flexible and extensible and are made of plastic material.

Figure 2:
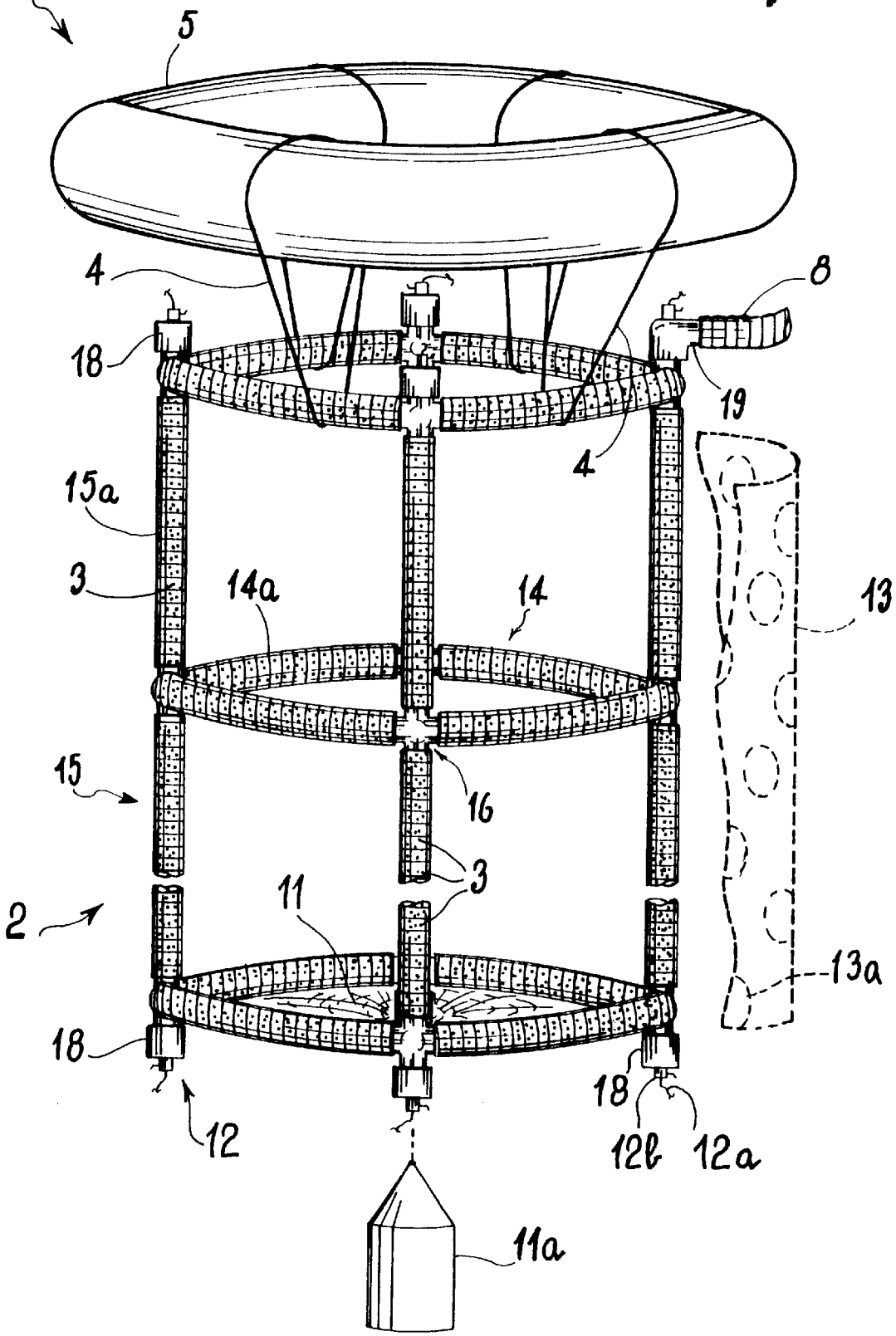
FIG. 2 is a perspective view of a first embodiment of the apparatus.

As shown in FIG. 2, the dispensing structure 2 comprises three and possibly only two annular perimetral tubular elements or rings 14 adapted to convey the fluid under pressure and provided with diffuser holes 3.

Rings 14 are disposed in operating position spaced from one another parallel to each other and to float 5 so as to perimetral delimit at different levels the side surface of the useful water volume or space 10 and are connected and in communication with at least two or preferably four rectilinear elements or uprights 15 that preferably enable passage of the fluid under pressure through rings 14 by connecting them along the vertical extension direction of space 10.

Both rings 14 and uprights 15 are divided into several portions so that they can be disassembled and are joined to each other by connection and communication sleeves or couplings 16, that are preferably rigid.

When four uprights 15 are provided, rings 14 comprise four arc-shaped portions 14*a*, whereas, if three rings 14 are provided, each upright 15 is divided into two lengths 15*a* each of which is interposed between two successive rings 14. Preferably all couplings 16 are identical and each of them has a spider-like shape formed of a first horizontal arm 16*a*, connected on opposite parts thereof to two arc-shaped portions 14*a* of a ring 14, and of a second vertical arm 16*b* transverse to the first one and connected to an upright 15 at least at one side thereof, as shown in FIG. 3.

If only couplings 16 are rigid, the same are engaged with rings 14 and uprights 15 by appropriate fastening clamps 17.

Couplings 16 put at the upper and lower ends of the dispensing structure 2 are closed by means of plugs 18.

Figure 3:
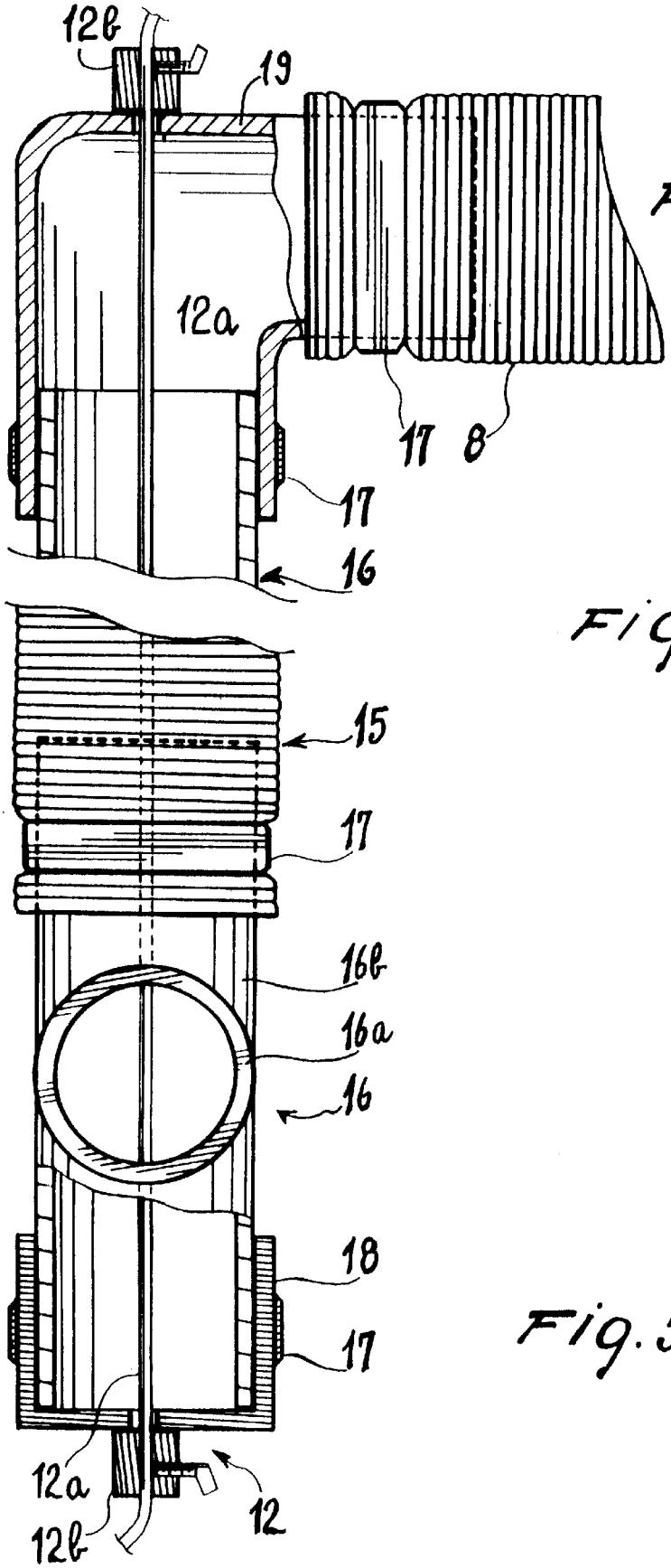
FIG. 3 highlights an enlarged portion partly in section of the apparatus shown in the preceding figure.

In one alone of the spider-shaped couplings 16 placed on top, an attachment 19 for the feeding hose 8 is provided instead of plug 18 (FIG. 3).

The arms 16*a*, 16*b* forming the couplings 16 can be not only straight and perpendicular to each other but they may also be constructed in a different way.

Figure 4:
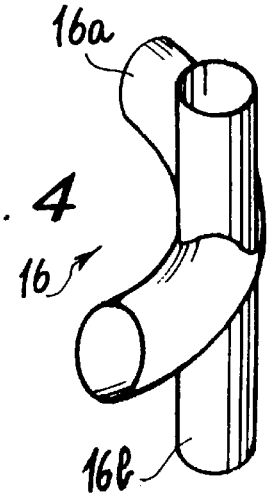
FIG. 4 shows a connection between tubular portions of the apparatus.
Figure 5:
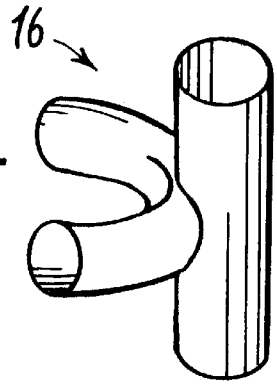
FIG. 5 shows a second further connection between tubular portions of the apparatus.

In FIGS. 4 and 5 in fact couplings 16 have the first arms 16*a*, i.e. those intended to be part of rings 14, extended in an arc-shaped configuration.

In addition, in FIG. 4 arms 16*a* and 16*b* completely intersect so that also the central axial lines of rings 14 and uprights 15 intersect with each other, whereas in FIG. 5 arms 16*a* and 16*b* are disposed externally close to each other and are provided with a side hole 20 for passage of the fluid under pressure therethrough.

In the last-mentioned case also the central axial lines of the rings and uprights do not intersect with each other and the fluid flowing in the uprights is mainly conveyed thereinto keeping said uprights well outstretched if they are at least partly flexible.

When uprights 15 are flexible and extensible as in FIGS. 2 and 3, they preferably include bellows-shaped portions.

With this construction the adjusting means 12 is used to delimit the length of the uprights 15 and comprises inextensible cables 12*a* disposed internally of the uprights themselves and locking elements 12*b* to be fastened to the cables, for instance clamps adapted to abut against end portions of said uprights 15 where the plugs 18 for the spider-like couplings 16 are present.

Obviously rings 14 and uprights 15 can be completely stiff and directly connected with each other at connection and communication points forming a single cage-shaped body.

This technical solution is preferred when the environmental conditions are unfavorable and there are dangerous conditions so that it is suitable for the person using the operating unit 1*a* to be well protected.

Alternatively, a combination of stiff elements and flexible elements may be provided. For instance, rings 14 may be stiff and uprights 15 may be flexible. Uprights 15 can also be the only tubular elements of the apparatus; rings 14 may be mere stiff metal straps in the form of a loop defining the position of the uprights 15 through which fluid under pressure flows.

Figure 6:
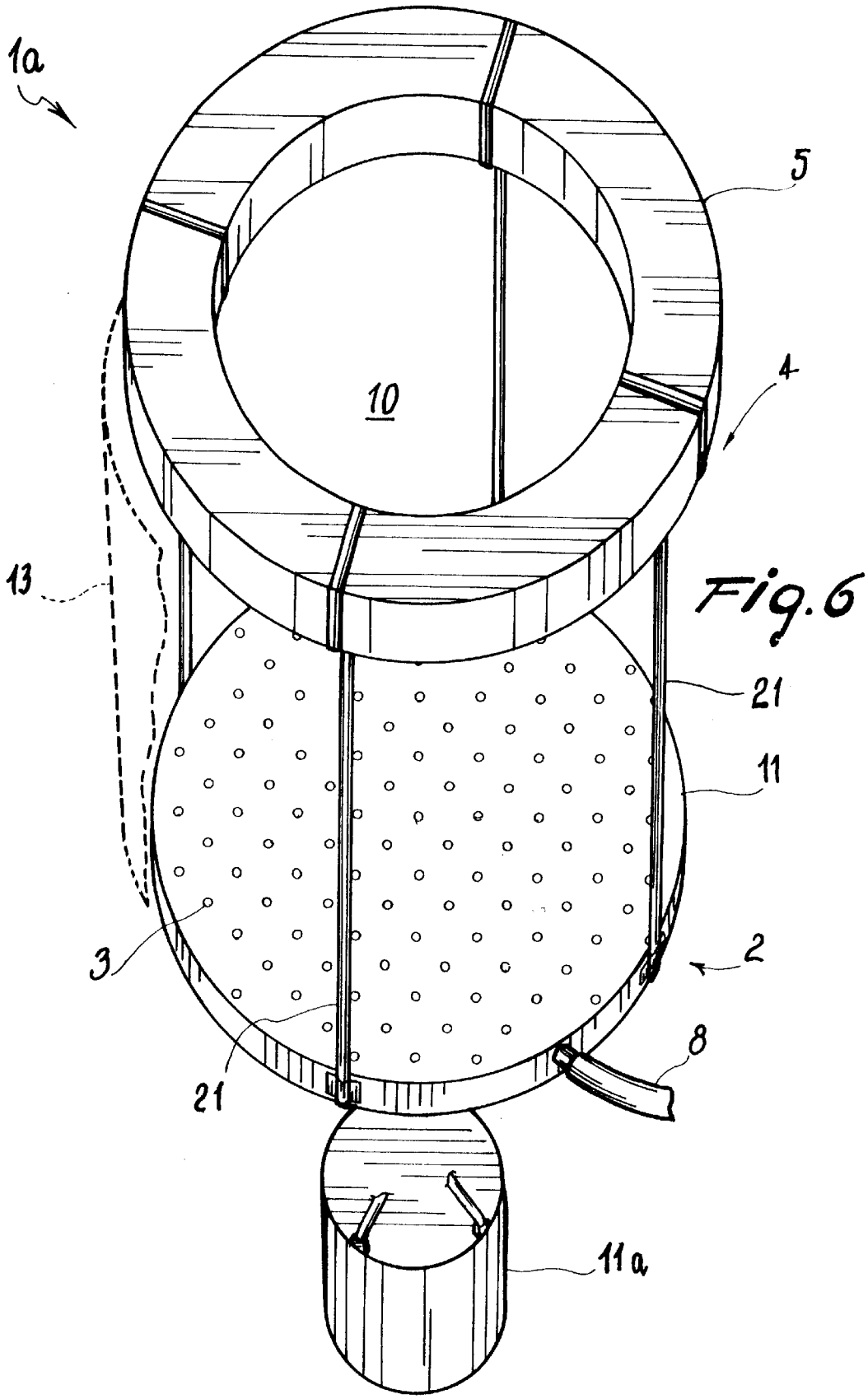
FIG. 6 is a perspective view of a second embodiment of the apparatus.

FIG. 6 shows an embodiment of the invention which is distinguishable for its simplicity.

Therein the dispensing structure 2 is mainly defined by platform 11 taking the conformation of an internally hollow blowing platform provided with holes 3 for emitting fluid under pressure at least at the upper portion thereof and directly connected with hose 8.

In this embodiment the uprights 15, support means 4 and adjusting means 12 are substantially coincident.

In fact, they are made up of tie-rods 21 that can be easily modified in length, thereby establishing the suspension depth of platform 11 relative to float 5. In addition float 5 consists of a stiff unsinkable element.

Figure 7:
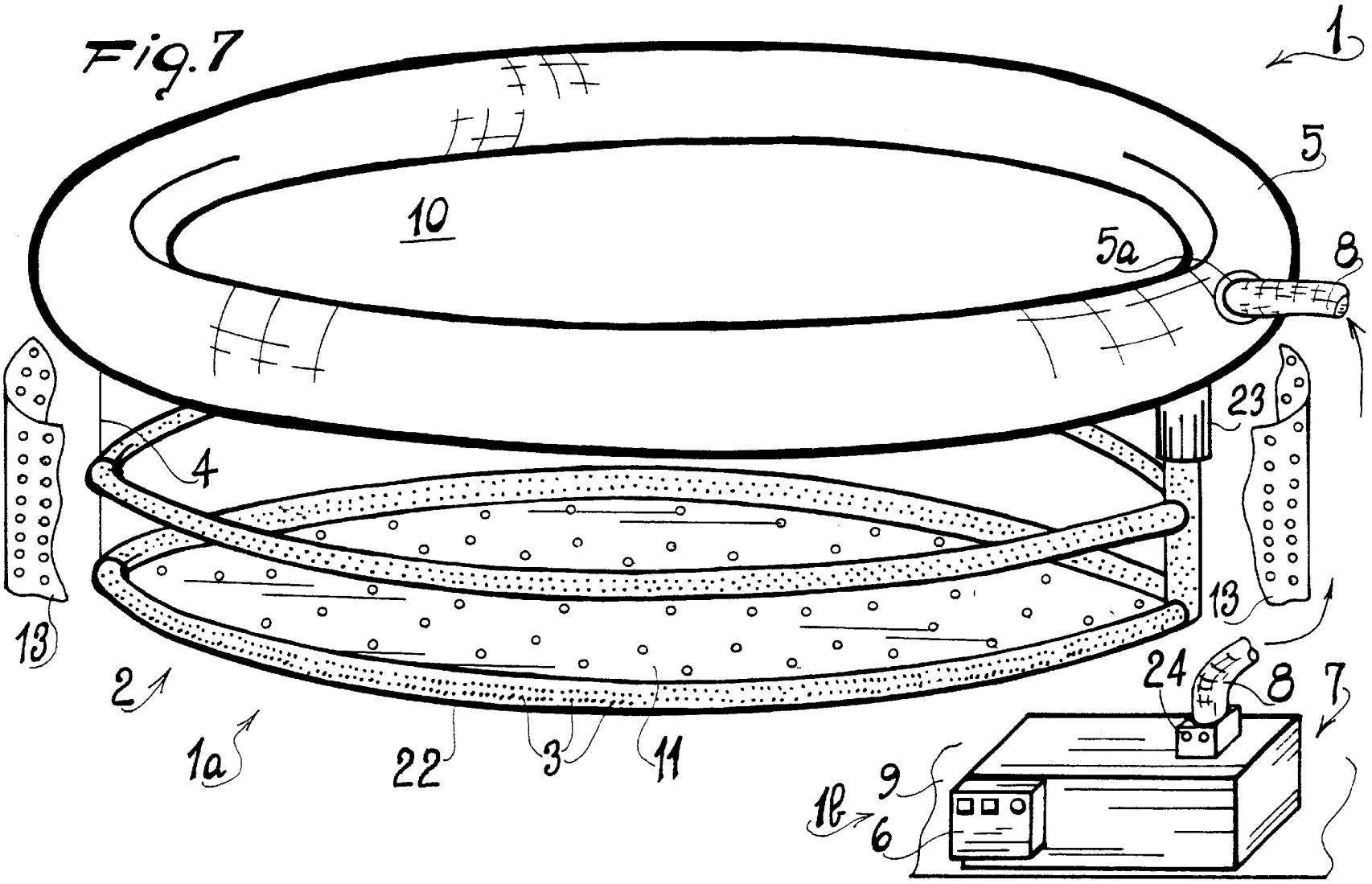
FIG. 7 is a perspective view of a further embodiment of the apparatus.

In the embodiment shown in FIG. 7 the dispensing structure 2 is formed of a series of substantially-annular inflatable tubular elements 22 pierced with holes, made of plastic material, and the bottom or platform 11 is pierced with holes as well and at least partly inflatable, so as to be made rigid by inflation. As visible, the dispensing structure may have a height that is smaller than the width.

Float 5 is inflatable too and directly supplied from the feeding means 1*b*.

In particular the channeling members 8 are directly in communication with the inflatable float 5.

This direct feeding can take place in parallel to or in series with feeding of fluid under pressure to the perforated dispensing structure 2.

At all events, the whole operating unit 1*a* can be directly inflated in water and also maintained completely deflated when it is on a boat.

Preferably, as in the technical solution shown in FIG. 7, the channeling members 8 are exclusively connected to an attachment 5*a* of the inflatable float 5 and the perforated dispensing structure 2 is supplied from float 5 with which it is in communication.

In this case priority in operation is given to the inflatable float 5 ensuring the major floating thrust of the operating unit 1*a*.

In this situation the condition of stable inflation—in water—of the inflatable float 5 is advantageously further ensured by an overpressure valve 23 interposed between float 5 and the underlying dispensing structure 2 and adapted to enable flowing of the fluid under pressure in the direction of the dispensing structure 2 only in the presence of a pressure in float 5 higher than a predetermined maximum inflation pressure.

In this way one can be sure that said float keeps perfectly inflated even in the presence of an interruption in the action of compressor 7.

Obviously, the compressor must be provided with a stopping element 24 for the return flow, to be deactivated when deflation of the float 5 is desired. Use of the apparatus is as follows.

Under non-use conditions, all elements can be held close to each other and/or disassembled and/or nonrigid with a minimum bulkiness.

When desired, the apparatus can be assembled and/or inflated in an immediate manner and also conveniently arranged to size for the person wishing to use it. In this way it can be employed with the greatest safety by children too in the open sea.

The flow of fluid generated by compressor 7 gives rise to a great turbulence which is perfectly localized even in the presence of currents and waves. Since the feeding means can easily supply air with a pressure of many atmospheres, operation of the apparatus is ensured even in the presence of a great number of holes and also in the presence of possible losses at the junctions.

The holes can be directed in all directions so as to form, also together with possible losses, a wide turbulent environment which is very useful when possible currents or water displacements tend to deviate the turbulence generated by the air jets.

In addition the apparatus is steady and safe due to the presence of float 5. It should be also recognized that, since a surrounding structure is provided around the persons utilizing the apparatus, the same also appears as a protection against possible attacks from sharks. The invention achieves important advantages.

In fact the apparatus in accordance with the invention enables to take advantage of the benefits obtainable from hydromassages or treatments contemplating a physical contact with jets of fluids or with fluids made turbulent, at any place, provided there is the presence of water volumes sufficient to enable immersion of the operating unit.

In particular, it should be pointed out that the minimum volume of the operating unit when it is not used enables the same to be easily transported and facilitates its use also in case of navigation with boats of limited tonnage, where it can be disposed at the stern board for example.

The apparatus can also become an important element for swimming pools, lakes, thermal stations.

What is claimed is:

1. An apparatus for execution of hydromassages, comprising at least one operating unit to be plunged into water and delimiting at least one space for housing at least one person, said operating unit having at least one dispensing structure provided with diffuser holes for dispensing a fluid under pressure to said space and at least one float for supporting said dispensing structure immersed in the water, the apparatus further comprising feeding means for causing flowing of said fluid under pressure towards said space, wherein said dispensing structure comprises rings that, in an operating position, are disposed substantially parallel to each other and to said float, and uprights connected to said rings which, in said operating position, are disposed substantially transversely of said rings.

2. The apparatus as claimed in claim 1, wherein said feeding means are external to said operating unit and further comprising compression members for said fluid and channeling members extending between said compression members and said operating unit.

3. The apparatus as claimed in claim 2, wherein said float is inflatable and wherein said channeling members are in fluid-conducting communication with said float.

4. The apparatus as claimed in claim 3, wherein said channeling members are connected to said inflatable float and wherein said dispensing structure is in fluid-conducting communication with said float.

5. The apparatus as claimed in claim 4, further comprising an overpressure valve inserted between said float and said dispensing structure, said valve being adapted to enable flowing of said fluid under pressure to said dispensing structure only in the presence of a pressure in said float higher than a predetermined pressure value.

6. The apparatus as claimed in claim 1, wherein said float is a ring-shaped element defining an upper border of said operating unit.

7. The apparatus as claimed in claim 1, further comprising means for suspending said dispensing structure from said float.

8. The apparatus as claimed in claim 1, wherein said dispensing structure comprises a platform having a distance relative to said float and being adapted to support at least one person.

9. The apparatus as claimed in claim 8, wherein said platform is defined by a net.

10. The apparatus as claimed in claim 8, further comprising means for selectively adjusting said distance of said platform relative to said float.

11. The apparatus as claimed in claim 10, wherein said adjusting means comprise cables extending between said float and said platform and locking elements to be fastened to said cables at selected positions of said cables to adjust said distance of said platform relative to said float.

12. The apparatus as claimed in claim 1, wherein said dispensing structure is surrounded by a substantially laminar holding band.

13. The apparatus as claimed in claim 12, wherein said holding band is provided with openings.

14. The apparatus as claimed in claim 1, further comprising a stabilization mass hanging from a bottom of said dispensing structure.

15. The apparatus as claimed in claim 1, wherein said uprights are tubular and wherein said fluid under pressure is caused to pass through said uprights.

16. The apparatus as claimed in claim 15, wherein said uprights comprise tubes extensible in length.

17. The apparatus as claimed in claim 16, further comprising means for adjusting the length of said uprights, said means comprising inextensible cables passing internally of said uprights, and locking elements in the form of clamps to be fastened to said cables and constructed to abut against end portions of said uprights for engagement therewith.

18. The apparatus as claimed in claim 1, wherein said rings are tubular and wherein said fluid under pressure is caused to pass through said rings.

19. The apparatus as claimed in claim 1, wherein said uprights and said rings are tubular and comprise said diffuser holes, and wherein the apparatus further comprises couplings between said uprights and said rings to enable passage of the said fluid under pressure between said rights and said rings.

20. The apparatus as claimed in claim 1, wherein said dispensing structure comprises inflatable tubular elements.

21. The apparatus as claimed in claim 1, wherein said space has a height and a width and wherein said height is smaller than said width.

22. An apparatus for execution of hydro-massage, comprising at least one operating unit to be plunged into water and delimiting at least one space for housing at least one person, and means for feeding a fluid under pressure to said operating unit, said operating unit having at least one dispensing structure provided with diffuser holes for dispensing said fluid under pressure to said space, and at least one float for supporting said dispensing structure immersed in the water, wherein said dispensing structure comprises a plurality of perimetral elements which, in an operating position, are arranged spaced from one another at different levels and perimetrally surround said space, and a plurality of uprights which, in said operating position, extend substantially transverse to said perimetral elements and connect said perimetral elements with each other, said perimetral elements and said uprights being selectively provided with said diffuser holes.

23. An apparatus for execution of hydro-massages, comprising at least one operating unit to be plunged into water and delimiting at least one space for housing at least one person, said operating unit having at least one dispensing structure provided with diffuser holes for dispensing a fluid under pressure to said space and at least one float for supporting said dispensing structure immersed in the water, the apparatus further comprising feeding means for causing flowing of said fluid under pressure towards said space, wherein said at least one space for housing at least one person is vertically elongated, in an operating position, and comprises said at least one float in the form of a ring at an upper part of said at least one space for housing at least one person, at least one upright connected to said ring which, in said operating position, is disposed substantially transversely of said ring so as to extend downwardly, and wherein said at least one dispensing structure having diffuser holes for dispensing a fluid under pressure is disposed, in said operating position, at a lower part of said at least one vertical space for housing at least one person, and is attached to said at least one upright, and wherein said dispensing structure comprises an internally-hollow blowing platform having a plurality of said diffuser holes in at least one face facing said space, said internally-hollow blowing platform being adapted to support at least one person and being connected with said feeding means.

24. The apparatus as claimed in claim 23, wherein said feeding means are external to said operating unit and comprise compression members for said fluid and channeling members extending between said compression members and said operating unit.

25. The apparatus as claimed in claim 23, wherein said dispensing structure is surrounded by a substantially laminar holding band.

26. The apparatus as claimed in claim 25, wherein said holding band is provided with openings.

27. The apparatus as claimed in claim 23, further comprising a stabilization mass hanging from said platform.

* * * * *